US011655984B2

(12) United States Patent
Altamura et al.

(10) Patent No.: US 11,655,984 B2
(45) Date of Patent: May 23, 2023

(54) INDUCTION COOKTOP

(71) Applicant: Whirlpool Corporation, Benton Harbor, MI (US)

(72) Inventors: Davide Altamura, Fabriano (IT); Diego Bariviera, Fabriano (IT); Alessio Beato, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 609 days.

(21) Appl. No.: 16/774,740

(22) Filed: Jan. 28, 2020

(65) Prior Publication Data

US 2020/0166220 A1 May 28, 2020

Related U.S. Application Data

(60) Division of application No. 14/883,848, filed on Oct. 15, 2015, now Pat. No. 10,605,464, which is a (Continued)

(30) Foreign Application Priority Data

Oct. 15, 2012 (IT) ..... TO2012A000896

(51) Int. Cl.

| | |
|---|---|
| ***H05B 6/10*** | (2006.01) |
| ***H05B 6/06*** | (2006.01) |
| ***F24C 15/10*** | (2006.01) |

(52) U.S. Cl.

CPC ..... *F24C 15/107* (2013.01); *F24C 15/106* (2013.01); *H05B 6/062* (2013.01); *H05B 2213/05* (2013.01)

(58) Field of Classification Search

CPC ..... Y02E 60/10; F24C 15/106; F24C 15/107; H05B 2213/05; H05B 6/062

(Continued)

(56) References Cited

U.S. PATENT DOCUMENTS

| | | | |
|---|---|---|---|
| 3,259,837 | A | 7/1966 | Oshry |
| 3,814,888 | A | 6/1974 | Bowers et al. |

(Continued)

FOREIGN PATENT DOCUMENTS

| | | | |
|---|---|---|---|
| CN | 102396294 | A | 3/2012 |
| CN | 103596307 | A | 2/2014 |

(Continued)

OTHER PUBLICATIONS

Sarnago et al., "Multiple-Output ZCS Resonant Inverter for Multi-Coil Induction Heating Appliances," IEEE 2017, pp. 2234-2238.

(Continued)

*Primary Examiner* — Quang T Van

(74) *Attorney, Agent, or Firm* — Price Heneveld LLP

(57) ABSTRACT

An induction cooktop includes a ceramic cooking surface in connection with a housing. A plurality of inductors is disposed in the housing and each of the inductors is in communication with a controller. The controller is configured to selectively activate each of the inductors in response to an input received at the user interface identifying an active inductor of the plurality of inductors to activate. The controller is further configured to detect a presence of a pan proximate the active inductor in response to a detection signal and identify a small pan condition in response to a phase angle detected for the active inductor of the plurality of inductors.

20 Claims, 4 Drawing Sheets

Related U.S. Application Data continuation-in-part of application No. 14/435,814, filed as application No. PCT/IB2013/059340 on Oct. 14, 2013, now Pat. No. 11,212,880.

(58) Field of Classification Search
USPC .... 219/626, 665, 601, 620, 622, 489, 447.1, 219/465.1
See application file for complete search history.

(56) References Cited

U.S. PATENT DOCUMENTS 4,016,392 A 4/1977 Kobayashi et al.
4,029,926 A 6/1977 Austin
4,220,839 A 9/1980 De Leon
4,356,371 A 10/1982 Kiuchi et al.
4,415,788 A 11/1983 Field
4,431,892 A 2/1984 White
4,438,311 A 3/1984 Tazima et al.
4,464,553 A 8/1984 Ikeda
4,476,946 A 10/1984 Smith
4,540,866 A 9/1985 Okuda
4,629,843 A 12/1986 Kato et al.
4,695,770 A 9/1987 Raets
4,713,528 A 12/1987 Hirata
4,776,980 A 10/1988 Ruffini
4,810,847 A 3/1989 Ito
4,820,891 A 4/1989 Tanaka et al.
4,868,901 A 9/1989 Kniskern et al.
5,190,026 A 3/1993 Doty
5,523,631 A 6/1996 Fishman et al.
5,571,438 A 11/1996 Izaki et al.
5,640,497 A 6/1997 Woolbright
5,665,263 A 9/1997 Gaspard
5,686,006 A 11/1997 Gaspard
5,808,280 A 9/1998 Gaspard
5,866,884 A 2/1999 Cornec et al.
6,018,154 A 1/2000 Izaki et al.
6,078,033 A 6/2000 Bowers et al.
6,184,501 B1 2/2001 Zapf
6,230,137 B1 5/2001 Has et al.
6,242,721 B1 6/2001 Borrmann et al.
6,693,262 B2 2/2004 Gerola et al.
6,696,770 B2 2/2004 Nadot et al.
6,764,277 B2 7/2004 Somahara et al.
7,021,895 B2 4/2006 Rubenstein et al.
7,023,246 B2 4/2006 Scollo et al.
7,049,563 B2 5/2006 Keishima et al.
7,053,678 B2 5/2006 Scollo et al.
7,057,144 B2 6/2006 Hirota et al.
7,081,728 B2 7/2006 Kemp
7,274,008 B2 9/2007 Arnal Valero et al.
7,306,429 B2 12/2007 Horng et al.
7,390,994 B2 6/2008 Oh et al.
7,429,021 B2 9/2008 Sather et al.
7,504,607 B2 3/2009 Barragan Perez et al.
7,709,732 B2 5/2010 Phillips
7,759,616 B2 7/2010 Gouardo et al.
7,777,163 B2 8/2010 Hosoi et al.
7,786,414 B2 8/2010 Schilling et al.
7,910,865 B2 3/2011 Haag et al.
7,982,570 B2 7/2011 Burdick, Jr. et al.
8,017,864 B2 9/2011 Phillips
8,248,145 B2 8/2012 Melanson
8,263,916 B2 9/2012 Fujita et al.
8,350,194 B2 1/2013 Lee et al.
8,356,367 B2 1/2013 Flynn
8,431,875 B2 4/2013 Gutierrez
8,440,944 B2 5/2013 Acero Acero et al.
8,558,148 B2 10/2013 Artigas Maestre et al.
8,618,778 B2 12/2013 Gray et al.
8,658,950 B2 2/2014 Cho et al.
8,723,089 B2 5/2014 Sadakata et al.
8,742,299 B2 6/2014 Gouardo et al.
8,754,351 B2 6/2014 England et al.
8,791,398 B2 7/2014 De la Cuerda Ortin et al.
8,817,506 B2 8/2014 Shimomugi et al.
8,853,991 B2 10/2014 Shan et al.
8,878,108 B2 11/2014 Kitaizumi et al.
8,901,466 B2 12/2014 Schilling et al.
8,912,473 B2 12/2014 Roux
8,975,931 B2 3/2015 Koehler
9,006,621 B2 4/2015 Artal Lahoz et al.
9,060,389 B2 6/2015 Lee et al.
9,084,295 B2 7/2015 Sadakata et al.
9,113,502 B2 8/2015 Anton Falcon et al.
9,198,233 B2 11/2015 Brosnan et al.
9,269,133 B2 2/2016 Cho et al.
9,277,598 B2 3/2016 Lee et al.
9,282,593 B2 3/2016 Brosnan et al.
9,326,329 B2 4/2016 Kitaizumi et al.
9,347,672 B2 5/2016 Jungbauer et al.
9,356,383 B2 5/2016 Waffenschmidt et al.
9,370,051 B2 6/2016 Fossati et al.
9,374,851 B2 6/2016 Klein et al.
9,400,115 B2 7/2016 Kuwamura
9,491,809 B2 11/2016 Shaffer et al.
9,554,425 B2 1/2017 Sawada et al.
9,603,202 B2 3/2017 Shaw
9,609,697 B2 3/2017 Aldana Arjol et al.
9,622,296 B2 4/2017 Dehnert et al.
2003/0004647 A1 1/2003 Sinclair
2003/0163326 A1 8/2003 Maase
2005/0002784 A1 1/2005 Li et al.
2006/0289489 A1 12/2006 Wang
2007/0246458 A1 10/2007 Seok et al.
2009/0020526 A1 1/2009 Roux
2009/0084777 A1 4/2009 Oh et al.
2009/0321424 A1 12/2009 Buuel Magdalena et al.
2010/0044367 A1 2/2010 Kim et al.
2010/0163546 A1 7/2010 Nanno et al.
2010/0182136 A1 7/2010 Pryor
2011/0084058 A1 4/2011 Kim et al.
2011/0155200 A1 6/2011 Simka
2011/0240632 A1 10/2011 Anton Falcon et al.
2011/0272397 A1 11/2011 Artal Lahoz et al.
2011/0303653 A1 12/2011 Chun et al.
2012/0024835 A1 2/2012 Artal Lahoz et al.
2012/0024842 A1 2/2012 Thomann et al.
2012/0223070 A1 9/2012 Matsui et al.
2012/0248098 A1 10/2012 Lee et al.
2012/0261405 A1 10/2012 Kurose et al.
2012/0321762 A1 12/2012 Aranda Vazquez et al.
2013/0334210 A1 12/2013 Takehira et al.
2014/0305928 A1 10/2014 Thompson et al.
2015/0245417 A1* 8/2015 Fattorini ..... H05B 6/065 219/662
2015/0341990 A1 11/2015 Nagata et al.
2016/0037584 A1 2/2016 Viroli et al.
2016/0037589 A1 2/2016 Altamura et al.
2016/0135255 A1 5/2016 Ogawa et al.
2016/0234889 A1 8/2016 Aranda Vazquez et al.
2016/0330799 A1 11/2016 Leyh et al.
2016/0381735 A1 12/2016 Christiansen et al.
2016/0381736 A1 12/2016 Christiansen et al.
2017/0055318 A1 2/2017 Franco Gutierrez et al.
2017/0105251 A1 4/2017 Viroli et al.
2017/0142783 A1 5/2017 Herzog et al.
2017/0181229 A1 6/2017 Lomp et al.

FOREIGN PATENT DOCUMENTS

DE 7242625 U 3/1973
DE 3909125 A1 9/1990
DE 4228076 C1 8/1993
DE 19907596 A1 8/2000
DE 102004009606 A1 9/2005
DE 102007032757 A1 2/2008
DE 102007037881 A1 1/2009
DE 202009000990 U1 3/2009
DE 102007051666 A1 4/2009
DE 102010028549 A1 11/2010
DE 112008002807 B4 9/2013
DE 102013206340 A1 10/2014
DE 102014105161 A1 10/2015

(56) References Cited

FOREIGN PATENT DOCUMENTS

| | | | |
|---|---|---|---|
| DE | 102015220788 | A1 | 6/2016 |
| DE | 102015220795 | A1 | 6/2016 |
| EP | 498735 | A1 | 8/1992 |
| EP | 713350 | A1 | 5/1996 |
| EP | 722261 | A1 | 7/1996 |
| EP | 1137324 | A1 | 9/2001 |
| EP | 1505350 | A2 | 2/2005 |
| EP | 1610590 | A1 | 12/2005 |
| EP | 926926 | B1 | 11/2006 |
| EP | 1629698 | B1 | 12/2006 |
| EP | 1455453 | B1 | 9/2007 |
| EP | 2070442 | A2 | 6/2009 |
| EP | 1575336 | B1 | 1/2010 |
| EP | 2120508 | B1 | 12/2010 |
| EP | 2252130 | B1 | 8/2012 |
| EP | 2506662 | A1 | 10/2012 |
| EP | 2506674 | A1 | 10/2012 |
| EP | 2533605 | A2 | 12/2012 |
| EP | 2615376 | A1 | 7/2013 |
| EP | 2642820 | A1 | 9/2013 |
| EP | 2048914 | B1 | 10/2013 |
| EP | 2744299 | A1 | 6/2014 |
| EP | 2775785 | A1 | 9/2014 |
| EP | 2211591 | B2 | 10/2014 |
| EP | 1931177 | B1 | 5/2015 |
| EP | 2034799 | B1 | 5/2015 |
| EP | 2034800 | B1 | 5/2015 |
| EP | 2095686 | B1 | 5/2015 |
| EP | 2204072 | B1 | 7/2015 |
| EP | 2731402 | B1 | 8/2015 |
| EP | 2975289 | A2 | 1/2016 |
| EP | 1303168 | B1 | 3/2016 |
| EP | 2445309 | B1 | 5/2016 |
| EP | 2525485 | B1 | 7/2016 |
| EP | 2543232 | B1 | 7/2016 |
| EP | 2352359 | B1 | 8/2016 |
| EP | 2838316 | B1 | 10/2016 |
| EP | 2427032 | B1 | 12/2016 |
| EP | 3139702 | A1 | 3/2017 |
| EP | 3170363 | A1 | 5/2017 |
| EP | 3042541 | B1 | 6/2017 |
| EP | 2416621 | B1 | 7/2017 |
| EP | 3030042 | B1 | 8/2017 |
| EP | 3079443 | B1 | 11/2017 |
| EP | 2914059 | B1 | 12/2017 |
| ES | 2201937 | A1 | 3/2004 |
| ES | 2310962 | A1 | 1/2009 |
| ES | 2328540 | B1 | 9/2010 |
| ES | 2340900 | B1 | 5/2011 |
| ES | 2362523 | B1 | 8/2012 |
| FR | 2659725 | A1 | 9/1991 |
| FR | 2712071 | A1 | 5/1995 |
| FR | 2863039 | A1 | 6/2005 |
| FR | 2965446 | A1 | 3/2012 |
| GB | 2048025 | B | 1/1983 |
| JP | H07211443 | A | 8/1995 |
| JP | H07211444 | A | 8/1995 |
| JP | H08187168 | A | 7/1996 |
| JP | 2000350367 | A | 12/2000 |
| JP | 2001196156 | A | 7/2001 |
| JP | 3225240 | B2 | 11/2001 |
| JP | 2008153046 | A | 7/2008 |
| JP | 2009117378 | A | 5/2009 |
| JP | 2009158225 | A | 7/2009 |
| JP | 4932548 | B2 | 5/2012 |
| KR | 20020055465 | A | 7/2002 |
| KR | 20170019888 | A | 2/2017 |
| WO | 199737515 | A1 | 10/1997 |
| WO | 2005069688 | A2 | 7/2005 |
| WO | 2008031714 | A1 | 3/2008 |
| WO | 2008122495 | A1 | 10/2008 |
| WO | 2009016124 | A1 | 2/2009 |
| WO | 2009049989 | A1 | 4/2009 |
| WO | 2009053279 | A1 | 4/2009 |
| WO | 2010101135 | A1 | 9/2010 |
| WO | 2011128799 | A1 | 10/2011 |
| WO | 2011148289 | A1 | 12/2011 |
| WO | 2012104327 | A1 | 8/2012 |
| WO | 2014060928 | A2 | 4/2014 |
| WO | 2014156010 | A1 | 10/2014 |
| WO | 2016010492 | A1 | 1/2016 |
| WO | 2016015971 | A1 | 2/2016 |
| WO | 2016071803 | A1 | 5/2016 |
| WO | 2016087297 | A1 | 6/2016 |
| WO | 2016134779 | A1 | 9/2016 |
| WO | 2017109609 | A1 | 6/2017 |
| WO | 2017115334 | A1 | 7/2017 |

OTHER PUBLICATIONS

Sarnago et al., "Modulation Scheme for Improved Operation of an RB-IGBT-Based Resonant Inverter Applied to Domestic Induction Heating," IEEE Transactions on Industrial Electronics, vol. 60, No. 5, May 2013, pp. 2066-2073.

* cited by examiner

INDUCTION COOKTOP

CROSS-REFERENCE TO RELATED APPLICATIONS

The present application is a division of U.S. application Ser. No. 14/883,848 entitled "INDUCTION COOKTOP" and filed Oct. 15, 2015, now U.S. Pat. No. 10,605,464, which is a continuation-in-part of U.S. application Ser. No. 14/435,814, entitled "INDUCTION COOKING TOP" and filed Oct. 14, 2013, now U.S. Pat. No. 11,212,880, which is a National Phase Entry of International Application No. PCT/IB2013/059340 filed Oct. 14, 2013, which claims priority to Italian Application No. TO2012A000896 filed Oct. 15, 2012.

FIELD OF THE INVENTION

The present disclosure relates to an induction cooktop and more particularly to a controller for an induction cooktop.

BACKGROUND

Induction cooktops are devices which exploit the phenomenon of induction heating for food cooking purposes. Induction cooktops comprise a top made of glass-ceramic material upon which cooking units are positioned (hereinafter "pans"). Moreover there are provided inductors comprising coils of copper wire where an oscillating current (e.g. an alternating current) is circulated producing an oscillating electromagnetic field.

The electromagnetic field has the main effect of inducing a parasitic current inside the pan, which is made of an electrically conductive ferromagnetic material. The parasitic current circulating in the pan produces heat by dissipation; such heat is generated only within the pan and it acts without heating the cooktop.

This type of flameless cooktop has a better efficiency than electric cooktops (i.e. a greater fraction of the absorbed electric power is converted into heat that heats the pan). In addition, induction cooktops are safer to use due to the absence of hot surfaces or flames, reducing the risk of burns for the user or of fire. The presence of the pan on the cooktop causes the magnetic flux close to the pan itself causing the power to be transferred towards the pan. The greater the size of the pan, the higher the power that can be transferred.

Since heat is generated by induced currents, a cooktop control system may be utilized to monitor currents flowing through the coils; in this way, the power supplied to each inductor can be adjusted. Moreover such current monitoring may provide for the control system to automatically detect a presence of a pan over the inductors and to automatically turn off the inductors in response to the absence of the pan on the cooktop. A drawback arising from the automatic detection, is that it is possible for small pans not to be detected by the control system. In such conditions, the presence of a small pan that is not detected by the control system may lead to the cooktop control system failing to activate the inductors. That is, the control system may fail to activate the passage of the current through the coils of the inductors and fail to heat the small pan.

The disclosure provides for a control system configured to provide an improved method of presence detection for pans, particularly small pans. The modification provides for improved detection and operation of an induction cooktop.

SUMMARY

According to one aspect of the present invention, an induction cooktop is disclosed. The induction cooktop comprises a ceramic cooking surface in connection with a housing. A plurality of inductors is disposed in the housing and each of the inductors is in communication with a controller. The controller is configured to selectively activate each of the inductors in response to an input received at the user interface identifying an active inductor of the plurality of inductors to activate. The controller is further configured to detect a presence of a pan proximate the active inductor in response to a detection signal and identify a small pan condition in response to a phase angle detected for the active inductor of the plurality of inductors.

According to another aspect of the present invention, a method of controlling a cooktop is disclosed. The method comprises selectively activating an active inductor in response to an input received at a user interface and detecting a presence of a pan proximate the active inductor in response to a detection signal. The method further comprises identifying a small pan condition in response to a phase angle detected for the active inductor. The phase angle is between a zero-crossing of an induced current and a leading edge of a voltage across an inverter switch configured to provide current to the active inductor.

According to yet another aspect of the present invention, a controller for identifying a small pan condition for an induction cooktop is disclosed. The controller is in communication with a plurality of inductors, an inverter switch, and a user interface. The controller is configured to selectively activate each of the inductors in response to an input received at the user interface identifying an active inductor of the plurality of inductors to activate. The controller is further configured to detect a presence of a pan proximate the active inductor in response to a detection signal. The controller is further configured to identify the small pan condition in response to a phase angle identified between a zero-crossing of an induced current and a leading edge of a voltage across the inverter switch.

These and other objects of the present disclosure may be achieved by means of a cooktop incorporating the features set out in the appended claims, which are an integral part of the present description.

BRIEF DESCRIPTION OF THE DRAWINGS

Further objects and advantages of the present disclosure may become more apparent from the following detailed description and from the annexed drawing, which is provided by way of a non-limiting example, wherein.

DETAILED DESCRIPTION OF EMBODIMENTS

Figure 1:
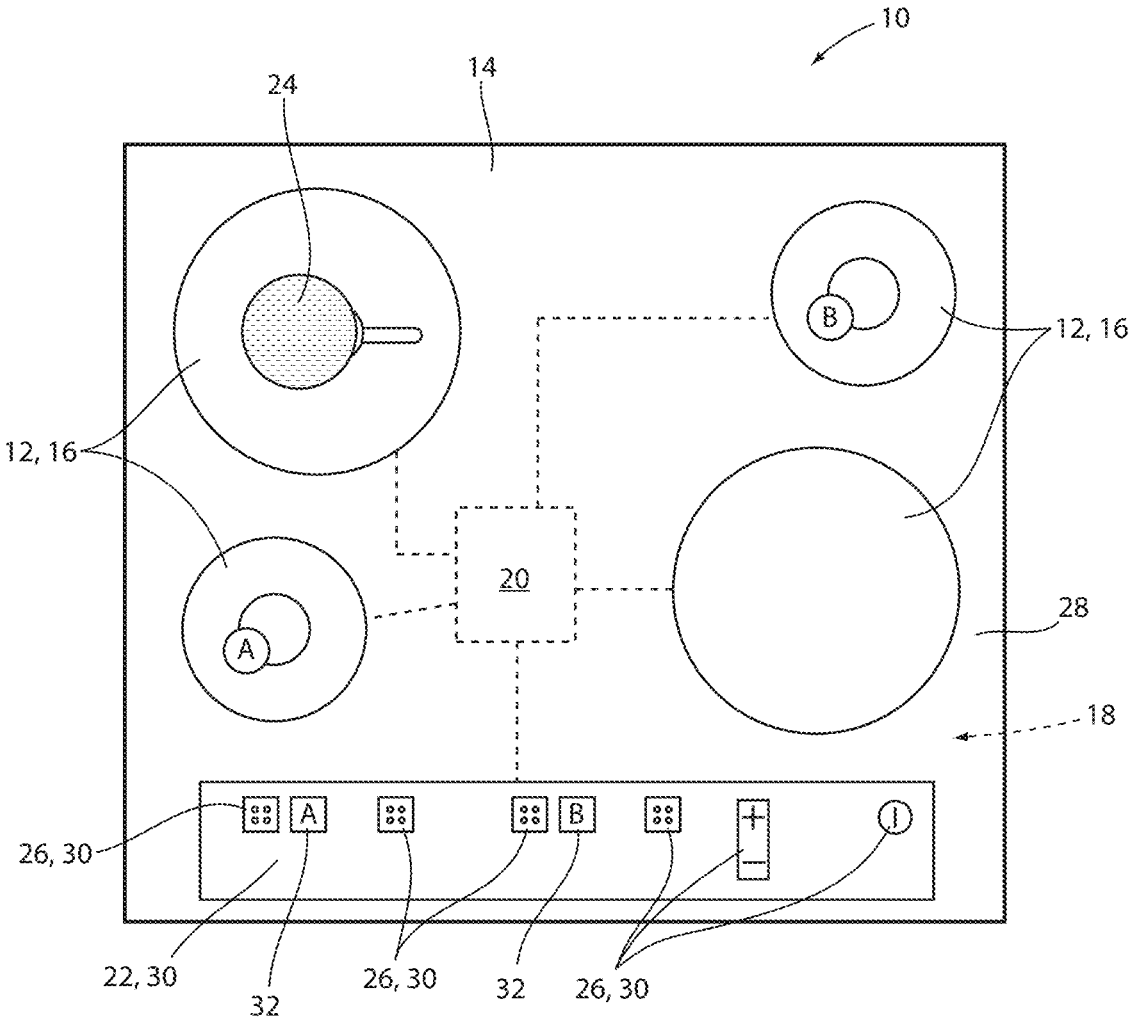
FIG. 1 is a top view of a cooktop according to the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a top view of a cooktop 10 is shown. The cooktop 10 may comprise a plurality of cooking hobs 12 oriented on a ceramic plate 14. Beneath the ceramic plate 14 and corresponding to each of the hobs 12, a plurality of induction coils 16 may be disposed in a housing 18. The induction coils 16 may be in communication with a controller 20 configured to selectively activate the induction coils 16 in response to an input to a user interface 22. The controller 20 may correspond to an automatic control system configured to activate one or more of the induction coils 16 in response to an input or user selection. Additionally, the controller 20 may only activate an induction coil upon identifying a presence of a ferromagnetic pan 24 proximate a selected hob of the plurality of hobs 12. The disclosure provides for an induction cooktop 10 operable to detect and activate a selected hob in response to the pan 24 corresponding to a small pan. Such pans may not be sensed by conventional induction cooktops due to safety systems that may mistakenly sense that no pan is present.

The user interface 22 may correspond to a touch interface configured to perform heat control and selection of the plurality of hobs 12 as illustrated in a plurality of instructive decals 26 disposed on a cooking surface 28 of the cooktop. The user interface 22 may comprise a plurality of sensors 30 configured to detect a presence of an object, for example a finger of an operator, proximate thereto. The sensors 30 may correspond to any form of sensors. In an exemplary embodiment, the sensors 30 may correspond to capacitive, resistive, and/or optical sensors. In an exemplary embodiment, the sensors 30 correspond to capacitive proximity sensors.

The user interface 22 may further comprise a display 32 configured to communicate at least one function of the cooktop 10. The display may correspond to various forms of displays, for example, light emitting diode (LED) display, a liquid crystal display (LCD), etc. In some embodiments, the display may correspond to a segmented display configured to depict one or more alpha-numeric characters to communicate a cooking function of the cooktop 10. The display may further be operable to communicate one or more error messages or status messages of the cooktop 10.

Figure 2:
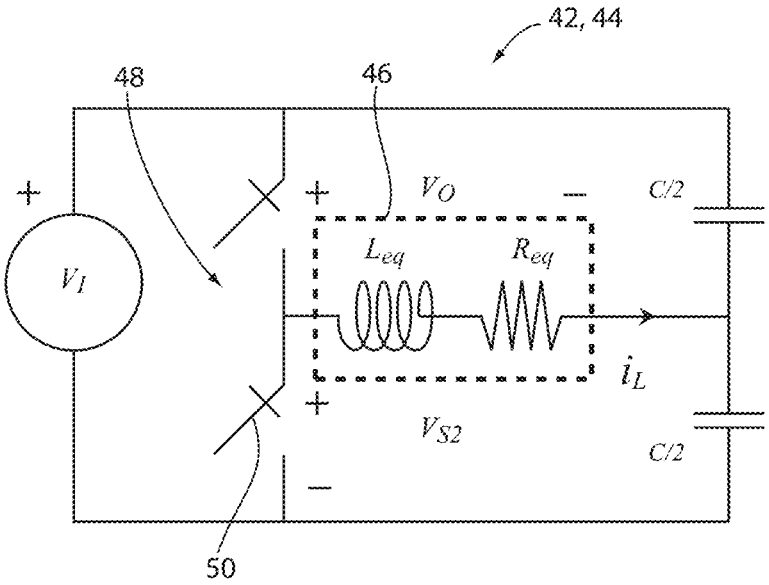
FIG. 2 is a schematic representation of an inductor and an example of a driving circuit.

Referring now to FIG. 2, a schematic view of an electronic circuit 42 in communication with the controller 20 is shown. The controller 20 is configured to apply the alternating current to drive each of the induction coils 16. As illustrated, an equivalent circuit model 44 of an exemplary induction coil 46 is shown and denoted as the equivalent inductance $L_{eq}$ and the equivalent resistance $R_{eq}$. The induction coil is further modeled having the equivalent capacitance C divided in the paths as C/2.

The controller 20 is configured to selectively drive the induction coil 46 in response to a detection of a user input into the user interface 22 and a detection of a pan 24 on the cooking surface 28. The induction coil 46 is driven in this example with a half bridge inverter 48. The controller 20 is configured to monitor the current $i_L$ driven through the induction coil 46. Additionally, the controller 20 is configured to monitor the voltage $V_{S2}$ on a lower switch 50 of the half bridge inverter 48. The phase angle between the zero-crossing of the current $i_L$ and the leading edge of the square wave of $V_{S2}$ can be derived from the current $i_L$ and the voltage $V_{S2}$. See FIG. 3 for a schematic representation of phase parameter.

Though a half bridge inverter is referred to herein, various driving circuits may be similarly utilized to control the induction coil 46 as described herein. For example, the induction coil 46 may correspond to a full bridge inverter or a quasi-resonant converter. The controller 20 may utilize a variety of sensor circuits to monitor the current $i_L$ and the voltage $V_{S2}$. Additionally, the controller 20 may comprise one or more processors or circuits configured to derive the identify the zero-crossing of the current $i_L$ and the leading edge of the voltage $V_{S2}$.

Figure 3:
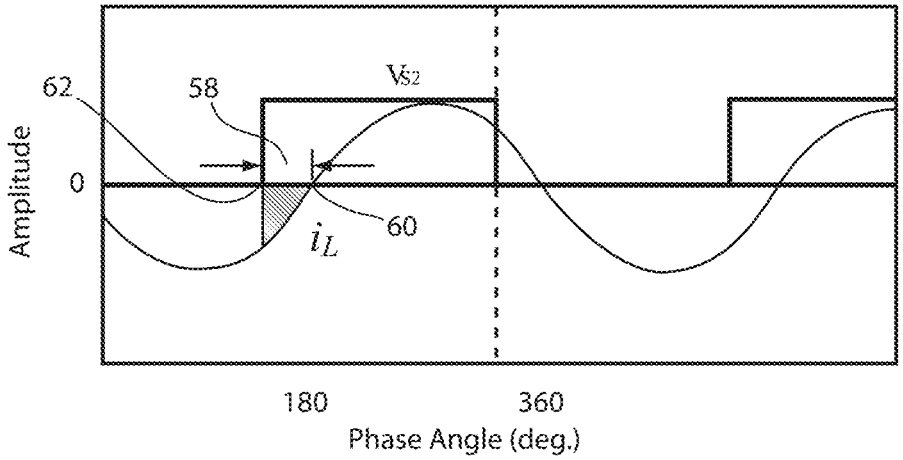
FIG. 3 is a representation of phase control parameter.

Referring now to FIG. 3, an exemplary plot of the current $i_L$ and the voltage $V_{S2}$ is shown. The controller 20 may monitor the phase angle 58 between the zero-crossing 60 of the current $i_L$ and the leading edge 62 of the square wave of $V_{S2}$. Based on the phase angle 58, the controller may identify various states of the cooktop 10. For example, if the phase angle 58 is approximately 90 degrees, the controller 20 may identify that the pan 24 is not present proximate an active or selected induction coil. Additionally, if the phase angle 58 is significantly less than 90 degrees the controller 20 may identify normal operation of the cooktop 10. As discussed in reference to FIG. 5, the controller 20 may be configured to provide for an identification of a pan not being present while providing for operation of the cooktop with the small pan 24.

The phase angle 58 identified in FIG. 3 corresponds to a low phase angle that is significantly less than 90 degrees and may correspond to normal operation of the cooktop 10. The control scheme applied by the controller 20 may provide for the detection of the phase angle 58 as well as the amplitude of the current to distinguish normal operation of the cooktop 10 in accordance with the disclosure. As discussed herein, the controller 20 may provide for the detection of the small pan 24 to improve operation of the cooktop 10 and enable utilization of the small pan 24 to improve the versatility of the cooktop 10.

Figure 4:
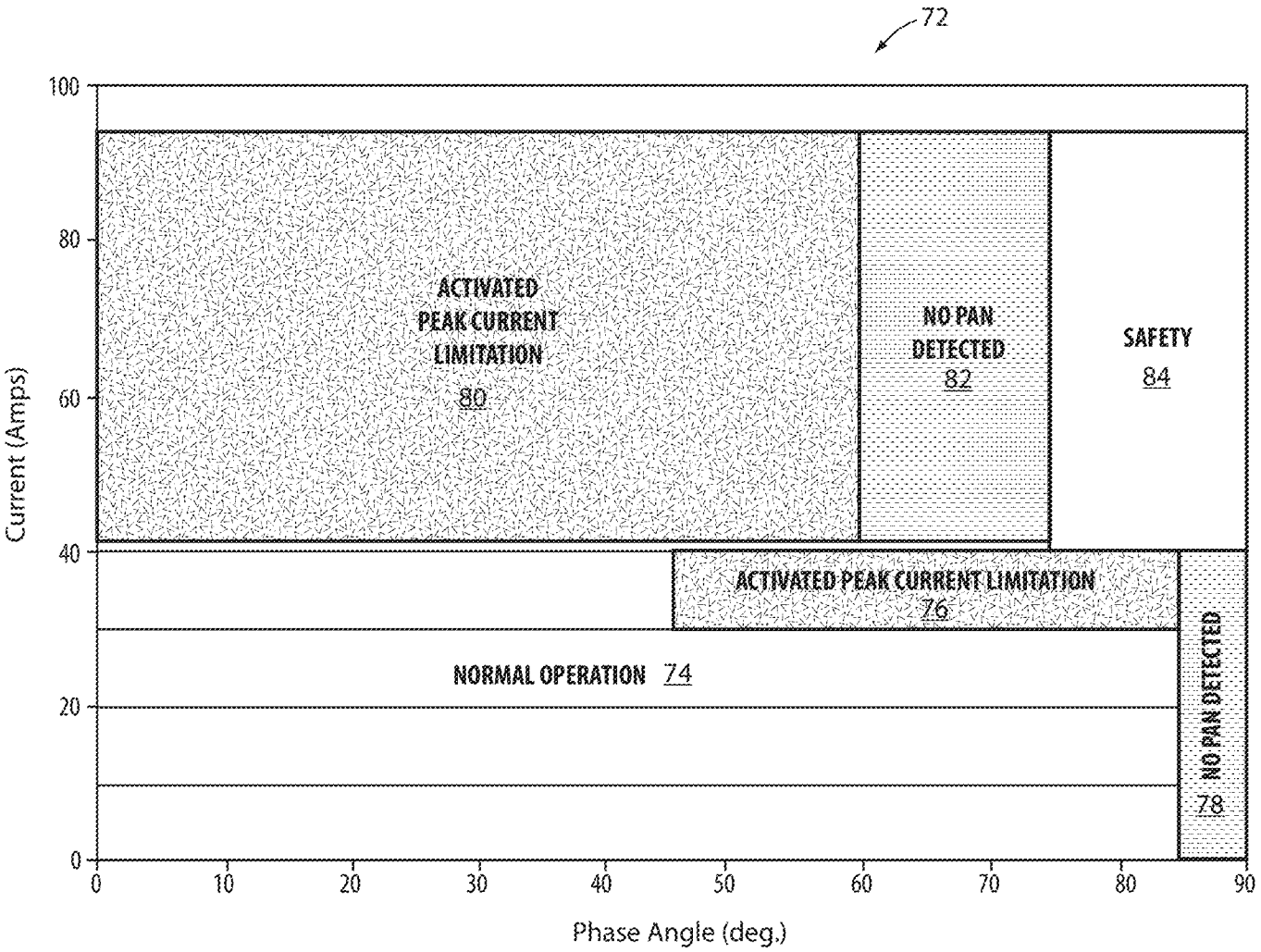
FIG. 4 is a plot of prior art control scheme for a controller of an induction cooktop.

Referring now to FIG. 4, a plot of prior art control scheme 72 for a controller of an induction cooktop is shown. The control scheme 72 utilizes the phase angle between the zero-crossing 60 of the current $i_L$ and the leading edge 62 of the square wave of $V_{S2}$ as a first variable. In addition to the phase angle, the control scheme 72 utilizes the current $i_L$ drawn by an induction coil to define operating parameters of an induction coil. In this way, the controller may be operable to distinguish normal operation of the cooktop, but may not provide for operation with a small pan.

The normal operation zone 74 of the control scheme 72 may correspond to the phase angle 58 ranging from approximately 0 degrees to 85 degrees with the current $i_L$ approximately less than 40 amps. Between a phase angle 58 of approximately 45 degrees and 85 degrees with the current $i_L$ approximately between 30 and 40 amps, the controller may activate a peak current limitation 76. Additionally, the controller 20 may identify the phase angle 58 approximately between 85 degrees and 90 degrees with the current $i_L$ approximately between 0 and 40 amps as a first no pan detected range 78 of operation. In response to this condition, the controller may fail to activate a selected induction coil even if a small pan is present. As such, the control scheme 72 may fail to provide for operation of an induction cooktop with small pans.

Therefore, the control scheme 72 may not provide for activation of an induction coil in the presence of a pan having such a size to have a surface in contact with the induction cooktop smaller than a size threshold (for example 50 $cm^2$). Such a size threshold may correspond to a working point falling in the area "NO PAN DETECTED" in the PHASE range 85°-90°. This can be an undesired operation, since in this case the user would like the system to operate and to activate; however, the activation may be limited for safety purposes.

The control scheme 72 of the controller may further provide for an activated peak current 80 limitation to be activated in response to the phase angle 58 approximately between 0 degrees and 60 degrees with the current $i_L$ approximately between 40 and 95 amps. Additionally, the controller may activate a second no pan detected range 82 of operation in response to the phase angle 58 approximately between 60 degrees and 75 degrees with the current $i_L$ approximately between 40 and 95 amps. Finally a safety warning zone 84 may correspond to the phase angle 58 approximately between 75 degrees and 90 degrees with the current $i_L$ approximately between 40 and 95 amps.

Figure 5:
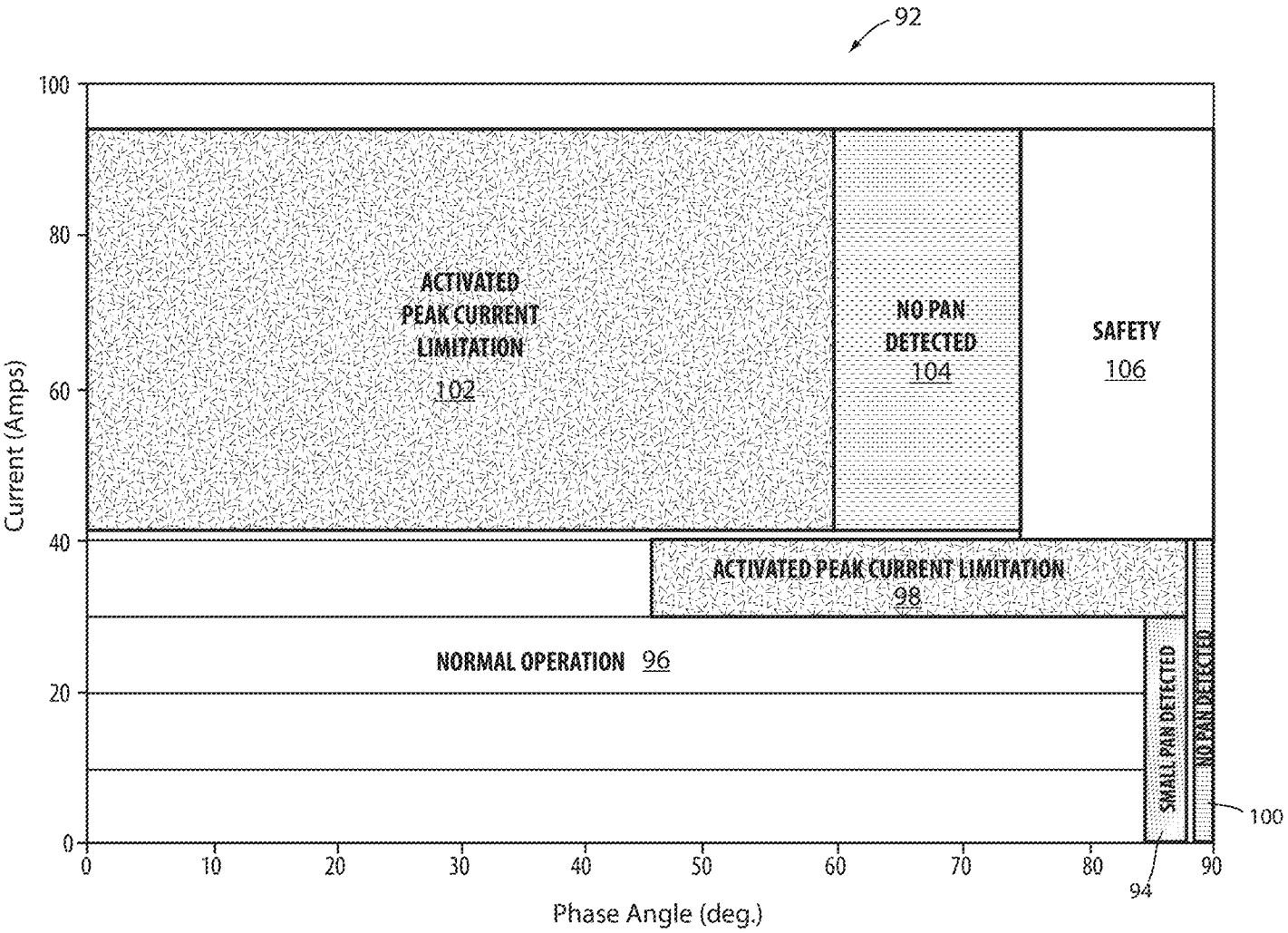
FIG. 5 is a plot of a modified control scheme for a controller of an induction cooktop providing for use of a small pan in accordance with the disclosure.

Referring now to FIG. 5, a plot of a modified control scheme 92 for the controller 20 of the induction cooktop 10 is shown. The control scheme may provide for enhanced operation by including a small pan operating range 94. The modified control scheme 82 similarly utilizes the phase angle between the zero-crossing 60 of the current $i_L$ and the leading edge 62 of the square wave of $V_{S2}$ as a first variable. In addition to the phase angle 58, the modified control scheme 82 utilizes the current $i_L$ drawn by an induction coil to define operating parameters of an induction coil. As further discussed, the controller 20 may provide for operation of the cooktop with the pan 24 and other small pans.

The normal operation zone 96 of the modified control scheme 92 may correspond to the phase angle 58 ranging from approximately 0 degrees to 85 degrees with the current $i_L$ approximately less than 40 amps. Between a phase angle 58 of approximately 45 degrees and 85 degrees with the current $i_L$ approximately between 30 and 40 amps, the controller may activate a peak current limitation 98. Additionally, the controller may identify the phase angle 58 approximately between 88 degrees and 90 degrees with the current $i_L$ approximately between 0 and 40 amps as a first no pan detected range 100 of operation. In response to this condition, the controller 20 may accurately identify a pan not present proximate a selected induction coil.

The controller 20 may identify the small pan operating range 94 in response to the phase angle 58 approximately between 84 degrees and 88 degrees with the current $i_L$ approximately less than 30 amps. The small pan operating range may further correspond to the phase angle 58 approximately between 85 degrees and 87 degrees. In this way, the controller 20 may be advantageously configured to operate at least one induction coil of the cooktop 20 to provide for operation with the small pan 24.

The modified control scheme 92 of the controller 20 may further provide for an activated peak current 102 limitation to be activated in response to the phase angle 58 approximately between 0 degrees and 60 degrees with the current $i_L$ approximately between 40 and 95 amps. Additionally, the controller 20 may activate a second no pan detected range 104 of operation in response to the phase angle 58 approximately between 60 degrees and 75 degrees with the current $i_L$ approximately between 40 and 95 amps. Finally a safety warning zone 106 may correspond to the phase angle 58 approximately between 75 degrees and 90 degrees with the current $i_L$ approximately between 40 and 95 amps.

In some embodiments, the control scheme may further provide for the controller 20 to periodically update to the detection of the small pan periodically during a cooking operation. That is, the controller 20 may continue to periodically monitor the phase angle 58 and the current $i_L$ throughout operation of each of the induction coils 16 or inductors of the cooktop 10. In response to identifying an inductor having a phase angle greater than 88 degrees for a predetermined time, the controller 20 may deactivate the inductor. The time interval for the predetermined time may vary. In some implementations, the time interval may be approximately 5 seconds.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only.

Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An induction cooktop, comprising:

a ceramic cooking surface in connection with a housing;

a plurality of inductors disposed in the housing; and a controller in communication with the inductors, wherein the controller is configured to:

selectively activate each of the inductors in response to an input received at the user interface identifying an active inductor of the plurality of inductors to activate;

detect a presence of a pan proximate the active inductor in response to a detection signal; and identify a small pan condition in response to a phase angle detected for the active inductor of the plurality of inductors.

2. The induction cooktop according to claim 1, further comprising:

an inverter comprising at least one inverter switch configured to drive the active inductor.

3. The induction cooktop according to claim 2, wherein the small pan condition is detected in response to a phase angle between a zero-crossing of an induced current and a leading edge of a voltage across the inverter switch.

4. The induction cooktop according to claim 3, wherein the phase angle is identified by determining a zero-crossing of the induced current in the active inductor.

5. The induction cooktop according to claim 3, wherein the phase angle is identified by determining the leading edge of a square wave of the voltage across the inverter switch.

6. The induction cooktop according to claim 3, wherein the controller is configured to identify the small pan condition in response to the phase angle being less than a pan presence threshold.

7. The induction cooktop according to claim 6, wherein the pan presence threshold corresponds to a phase angle approximately less than 88 degrees.

8. The induction cooktop according to claim 6, wherein the pan presence threshold corresponds to a phase angle approximately less than 87 degrees.

9. The induction cooktop according to claim 1, wherein the small pan condition corresponds to the detection of a small pan having a surface approximately less than 50 $cm^2$.

10. A method of controlling a cooktop, comprising:

selectively activating an active inductor in response to an input received at a user interface;

detecting a presence of a pan proximate the active inductor in response to a detection signal; and identifying a small pan condition in response to a phase angle detected for the active inductor, wherein the phase angle is between a zero-crossing of an induced current and a leading edge of a voltage across an inverter switch configured to provide current to the active inductor.

11. The method according to claim 10, wherein the phase angle is identified by determining a zero-crossing of the induced current in the active inductor.

12. The method according to claim 10, wherein the phase angle is identified by determining the leading edge of a square wave of the voltage across the inverter switch.

13. The method according to claim 10, wherein the small pan condition is detected in response to the phase angle being less than a pan presence threshold.

14. The method according to claim 10, further comprising:

identifying the small pan condition in response to a current driven through the active inductor being less than 30 amps.

15. A controller for identifying a small pan condition for an induction cooktop, the controller in communication with a plurality of inductors, an inverter switch, and a user interface, the controller configured to:

selectively activate each of the inductors in response to an input received at the user interface identifying an active inductor of the plurality of inductors to activate;

detect a presence of a pan proximate the active inductor in response to a detection signal; and identify the small pan condition in response to a phase angle identified between a zero-crossing of an induced current and a leading edge of a voltage across the inverter switch.

16. The controller according to claim 15, wherein the small pan condition is identified in response to a zero-crossing of the induced current in the active inductor and the leading edge of a square wave of the voltage across the inverter switch, wherein the inverter switch is configured to provide current to the active inductor.

17. The controller according to claim 15, wherein the controller is further configured to:

identify the small pan condition in response to the phase angle being less than a pan presence threshold.

18. The controller according to claim 17, wherein the pan presence threshold corresponds to a phase angle approximately less than 88 degrees.

19. The controller according to claim 15, wherein the controller is further configured to:

periodically update the identification of the presence of the pan during an operation of the active inductor.

20. The controller according to claim 19, wherein the controller is further configured to:

deactivate the active inductor in response to the periodic update detecting the phase angle greater than 88 degrees for a predetermined period of time.

* * * * *